US010266384B2

(12) United States Patent
Valles et al.

(10) Patent No.: US 10,266,384 B2
(45) Date of Patent: Apr. 23, 2019

(54) BEVERAGE DISPENSING APPLIANCE FOR MULTIPLE CONTAINERS

(71) Applicant: Anheuser-Busch InBev S.A., Brussels (BE)

(72) Inventors: Vanessa Valles, Leuven (BE); Stijn Vandekerckhove, Leuven (BE); Daniel Peirsman, Leuven (BE)

(73) Assignee: Anheuser-Busch InBev S.A., Brussels (BE)

( * ) Notice: Subject to any disclaimer, the term of this patent is extended or adjusted under 35 U.S.C. 154(b) by 0 days.

(21) Appl. No.: 15/504,654

(22) PCT Filed: Aug. 4, 2015

(86) PCT No.: PCT/EP2015/067969
§ 371 (c)(1),
(2) Date: Feb. 16, 2017

(87) PCT Pub. No.: WO2016/026693
PCT Pub. Date: Feb. 25, 2016

(65) Prior Publication Data

US 2017/0240409 A1 Aug. 24, 2017

(30) Foreign Application Priority Data

Aug. 19, 2014 (EP) ..... 14181401

(51) Int. Cl.
*B67D 1/08* (2006.01)
*B67D 1/00* (2006.01)
(Continued)

(52) U.S. Cl.
CPC ..... *B67D 1/0842* (2013.01); *B67D 1/0004* (2013.01); *B67D 1/0431* (2013.01);
(Continued)

(58) Field of Classification Search
CPC .. B67D 1/0842; B67D 1/0004; B67D 1/0835; B67D 1/0857; B67D 1/0892;
(Continued)

(56) References Cited

U.S. PATENT DOCUMENTS 3,545,475 A 12/1970 Johnson, Jr.
4,739,901 A 4/1988 Dorfman et al.
(Continued)

FOREIGN PATENT DOCUMENTS

DE 88 12 756 12/1988
DE 91 09 177 10/1991
(Continued)

*Primary Examiner* — Frederick C Nicolas
(74) *Attorney, Agent, or Firm* — Levy & Grandinetti

(57) ABSTRACT

A beverage dispensing device includes a container for a liquid beverage to be dispensed, a beverage dispensing line, and a gas line. A keg connector connects the keg interior with the dispensing and gas lines by coupling the keg connector to a container closure. A storing compartment receives at least two containers. An elongated tapping column is fixed to the top plate and provided with a tapping valve element. The receiving device has at least two containers permits container storage in a dispensing position with its longitudinal axis forming a storing angle of ±30° with respect to the top plane. The keg connector has a height measured along the longitudinal axis between the container's bottom end, and the furthest point of the keg connector coupled to the closure of the connector is not more than 5% greater than the height of the container without keg connector.

12 Claims, 6 Drawing Sheets

(51) Int. Cl.
*B67D 1/04* (2006.01)
*B67D 1/06* (2006.01)

(52) U.S. Cl.
CPC ..... *B67D 1/06* (2013.01); *B67D 1/0829* (2013.01); *B67D 1/0835* (2013.01); *B67D 1/0848* (2013.01); *B67D 1/0857* (2013.01); *B67D 1/0892* (2013.01); *B67D 2001/0098* (2013.01); *B67D 2210/00031* (2013.01)

(58) Field of Classification Search
CPC ..... B67D 2001/0098; B67D 1/0431; B67D 1/06; B67D 1/0829; B67D 1/0848; B67D 2210/00031
See application file for complete search history.

(56) References Cited

U.S. PATENT DOCUMENTS

| | | | | |
|---|---|---|---|---|
| 5,110,012 | A | 5/1992 | Scholle et al. | |
| 5,251,787 | A | 10/1993 | Simson | |
| 5,575,405 | A | 11/1996 | Stratton et al. | |
| 5,743,438 | A | 4/1998 | Sokolnicki | |
| 6,059,145 | A * | 5/2000 | Stratton | B67D 1/0021 222/113 |
| 6,481,238 | B1 | 11/2002 | Jennings et al. | |
| 6,708,741 | B1 * | 3/2004 | Berry | B67D 3/0009 141/351 |
| 6,871,679 | B2 | 3/2005 | Last | |
| 7,104,355 | B2 * | 9/2006 | Hoi | B60K 25/02 180/190 |
| 9,435,595 | B2 * | 9/2016 | Azhocar | F41A 11/00 |
| 9,580,289 | B2 * | 2/2017 | Peirsman | B67D 1/1405 |
| 9,821,996 | B2 * | 11/2017 | Stratton | B67D 3/0012 |
| 2004/0226967 | A1 * | 11/2004 | Van Der Klaauw | B67D 1/0412 222/146.6 |
| 2008/0217362 | A1 | 9/2008 | Vitantonio et al. | |
| 2011/0210148 | A1 | 9/2011 | Nelson et al. | |

FOREIGN PATENT DOCUMENTS

| | | |
|---|---|---|
| DE | WO 9407791 | 4/1994 |
| EP | 1 347 936 | 6/2002 |
| EP | 2 012 052 | 1/2009 |
| EP | 2 719 656 | 4/2014 |
| EP | 2 923 998 | 9/2015 |
| FR | 840904 | 5/1939 |
| FR | 2 579 441 | 10/1986 |
| WO | 98/40703 | 9/1998 |
| WO | WO 99/47451 | 9/1999 |
| WO | WO 01/07819 | 2/2001 |
| WO | WO 2007/108684 | 9/2007 |
| WO | WO 2008/129012 | 10/2008 |
| WO | WO 2008/129013 | 10/2008 |
| WO | WO 2008/129015 | 10/2008 |
| WO | WO 2008/129016 | 10/2008 |
| WO | WO 2008/129018 | 10/2008 |
| WO | WO 2009/090223 | 7/2009 |
| WO | WO 2009/090224 | 7/2009 |
| WO | WO 2009/090225 | 7/2009 |
| WO | WO 2012/004223 | 1/2012 |
| WO | WO 2012/056018 | 5/2012 |
| WO | WO 2014/057099 | 4/2014 |

* cited by examiner (a)

BEVERAGE DISPENSING APPLIANCE FOR MULTIPLE CONTAINERS

TECHNICAL FIELD

The present invention relates to beverage dispensing appliances comprising several containers stored in a compartment, each container being connectable to a tapping column by means of corresponding keg connectors allowing rapid and easy connection of a beer keg to a dispensing line and to a pressurized gas line. It concerns in particular a dispensing appliance adapted for use with the new generation of beer keg designs, which are smaller and generally made of polymers.

BACKGROUND FOR THE INVENTION

When beer or malt based fermented beverages (collectively referred to herein as "beer") are widely distributed stored in bottles and metal cans, there is a marked preference by the public for beers served directly on tap from a keg, referred to as draught (or draft) beer. Since draught beer was traditionally served in large volumes in public houses (pubs) and restaurants, large capacity re-usable metal kegs were traditionally used, typically 50 l kegs (=11 Imperial gallons). In recent years, however; a reduction of the kegs capacity offered on the market has been observed. There are two main factors explaining this trend.

First, brewers have developed various solutions for offering draught beer to particulars with specifically designed home appliances. It is clear that if 50 l kegs can be emptied reasonably rapidly in a pub, this is not the case for home appliances. Hence, smaller kegs of 5 to 15 l capacity were developed. Such home appliances are often referred to as "table top dispensers" because they are small enough to stand on top of a table.

Second, even in pubs, the tastes of the consumers have shifted from traditional lager beers towards special beers, with more specific flavours. This diversification of the types of beers offered for consumption in pubs has pushed brewers to store their special beers in smaller capacity kegs, ranging from 8 to 25 l kegs. Since such kegs are too large to stand on top of a counter, and probably too small to justify storing them in a basement far away from the tap, they are usually stored directly under the tapping column, usually in a refrigerated chamber. For this reason and by opposition to the expression "table top dispensers", such dispensing systems used in pubs are often referred to as "under the counter dispensers".

With the reduction of kegs capacity, however, the cost of packaging (=keg) per liter of beer sold increased accordingly. Alternative solutions to re-usable metal kegs, which need be cleaned and sterilized before each (re-) filling, had to be developed, typically replacing metal kegs by polymeric kegs made for example of PET and generally disposable and recyclable. Furthermore, pressure inside the container is usually raised by injecting pressurized $CO_2$ into the container, because air upon contacting the beer would oxidize and degrade it too rapidly. To allow the use of pressurized air fed e.g., by an air compressor to drive the dispensing of draught beer, integrally blow-moulded bag-in-containers were developed, wherein the beer is contained in a flexible inner bag inserted in an outer, rigid container, and pressurized gas is injected into the space between the inner bag and outer container to collapse the inner bag and drive the beer out of the bag. As illustrative examples, integrally blowmoulded polymeric bag-in-containers are disclosed in WO2008129018, WO2008129016, WO2008129012, WO2008129015, or WO2008129013.

Regardless of its size, before use a beer keg must be connected to a dispensing line and to a source of pressurized gas. Home appliances have been designed with their own specific solution for rapidly connecting a dispensing line and a gas source to the interior of the kegs (cf. e.g., WO2012056018), U.S. Pat. No. 5,251,787, U.S. Pat. No. 5,110,012, or U.S. Pat. No. 4,739,901. In some cases, the source of pressurized gas is stored in the keg itself, but this solution is rather expensive and to date implementable with quite small kegs only (cf. e.g., WO9947451, WO2007/108684). In pubs, however, although the kegs designs have changed dramatically as discussed above, the same equipment as for large 50 l kegs is often still being used downstream from the keg all the way to the tap, including the keg connector, the dispensing line and gas duct, and draught column and tap. For example, conventional keg connectors are usually made of metal, are heavy, complex and expensive. Examples of conventional keg connectors are disclosed in WO9407791, U.S. Pat. No. 3,545,475, DE9109177U. They are ill-fitted for smaller polymeric kegs, typically of 8 to 25 l kegs. Some solutions have been proposed to replace conventional keg connectors with simpler connectors.

WO2007/108684 discloses a simplified keg connector comprising a single connection to a dispensing tube. The keg connector is designed without a connection to a pressurized gas tube because the pressurized gas source is stored in a container located inside the keg. Absent a connection to a pressurized gas source, the requirements, in particular mechanical, clamping, and sealing properties, on the keg connector are substantially reduced, and the size thereof could be reduced accordingly. Numerous connectors for coupling a single dispensing duct to a container comprising no pressurized gas connection have been disclosed in fields other than beer kegs, such as in U.S. Pat. No. 6,871,679, EP2012052, or WO200107819, but are not suitable for a quick connection of a beer keg to both a dispensing line and a pressurized gas source.

WO9840703 discloses a connector for coupling a container containing chemicals to a dispensing line and a gas line. This connector is, however, bulky and oversized for connecting small beverage kegs of about 8 to 25 l capacity. EP1347936 discloses a small size keg connector comprising a connection to both a source of pressurized gas and a dispensing tube. The keg connector of EP1347936, however, is not connected to a closure of the keg, as it acts as a closure per se. Each new keg is sold with such connector already clamped into position with a new dispensing line coupled thereto. A keg connector concomitantly acting as closure is also disclosed in US2011210148 and US2008217362 but in these cases, the connectors are reversibly coupled to a container by a thread and can be removed therefrom and used with a new container. Closures acting also as connectors have been used extensively for "table top dispensers" such as disclosed in U.S. Pat. No. 5,251,787, U.S. Pat. No. 5,110,012, WO2012056018, cited above, and the like. These, however, are not suitable for use in pubs, wherein kegs are to be coupled in fluid communication with corresponding dispensing tap columns in "under the counter dispensers".

It is advantageous to store the containers in a refrigerated chamber, possibly located under the counter supporting the tap columns. Because of their size, conventional kegs are always used standing vertically when connected to a tap column. Indeed, they are designed with a bottom chime allowing their stable standing and they are so heavy that they cannot be handled easily. Furthermore the dispensing of beer stored in conventional kegs requires a hollow spear to penetrate deep into the beverage in order to allow the flow thereof through the spear upon increase of the pressure in the keg. If a keg were lying on its side, the spear would cease to be submerged under the level of beverage as soon as the keg would be about half empty; unless a flexible spear is used. Smaller kegs, however, are disadvantageous compared with larger kegs, because they occupy only a fraction of the height available in the storing compartment and fully occupied below the counter by larger kegs.

There remains a need in the art for under the counter appliances of the type used in pubs and restaurants, which are particularly adapted for smaller kegs of the order of 8 to 25 l capacity and usually made of polymeric material. The present invention proposes such dispensing appliance. These and other advantages of the present invention are discussed more in details in the following sections.

SUMMARY OF THE INVENTION

The present invention is defined in the appended independent claims. Preferred embodiments are defined in the dependent claims. In particular, the present invention concerns a beverage dispensing device comprising:

(a) container containing a liquid beverage to be dispensed, and extending over a height, H1, along a longitudinal axis, X1, from:
  (i) a closure sealing an opening of the container, adjacent to
  (ii) a neck region broadening into
  (iii) a shoulder region until reaching
  (iv) a substantially cylindrical body portion (8*b*) adjacent to
  (v) a bottom end, (b) A beverage dispensing line comprising an inlet end (4*u*) located at an upstream portion of the dispensing line, and an outlet end (4*d*) located at a downstream portion of the dispensing line, (c) A gas line comprising an inlet end (6*u*) and an outlet end (6*d*) said inlet end being connected to a source of pressurized gas, (d) A keg connector suitable for bringing in fluid communication the interior of the container with, on the one hand, the inlet end of the dispensing line and, on the other hand, with the outlet end of the gas line by coupling said keg connector to the closure of the container;

(e) A storing compartment comprising means for receiving at least two containers, and closed at the top by a top plate defining a top plane, π, said top plate being provided with an outlet opening suitable for allowing the outlet end of the dispensing line to be out of the storing compartment, while the inlet end thereof is connected to said keg connector coupled to the closure of one container stored in said storing compartment;

(f) An elongated tapping column, comprising an upstream portion fixed to said top plate and a downstream portion provided with a tapping valve element with an inner channel linking the upstream portion to the downstream portion of the column and in fluid communication with the outlet opening, said inner channel being suitable for receiving the dispensing line, and engaging the downstream portion of the dispensing line into the tapping valve element for controlling the flow of liquid out of the outlet end, Characterized in that, the means for receiving at least two containers in the storing compartment are such that each container is stored in a dispensing position with its longitudinal axis, X1, forming a storing angle of ±30° (i.e., comprised between −30° and) +30° with respect to the top plane, π, preferably between ±10°, preferably between ±5°, and in that, the keg connector is such that the height, H2, measured along the longitudinal axis, X1, between the bottom end of a container and the furthest point of the keg connector coupled to the closure of said connector is not more than 5% greater than the height, H1, of said container without keg connector, $(H2-H1)/H1 \leq 5\%$.

In a preferred embodiment, the upstream portion of the dispensing tube and the downstream portion of the gas tube are each independently coupled to the keg connector with an angle comprised between 45 and 135° preferably, between 80 and 100°, with respect to the longitudinal axis, X1, when the keg connector is coupled to the container, such that the height, H2, preferably includes at least 20 cm of both the upstream portion of the dispensing tube and the downstream portion of the gas tube.

A keg connector according to the present invention is preferably re-usable several times with new containers, and can be reversibly coupled to containers. In particular it preferably comprises a platform structure defined by a perimeter and comprising an upper surface and a lower surface and being provided with a clamping system for reversibly coupling the keg connector to the closure of a keg, said clamping system comprising:

(a) Two clamping legs jutting out of the lower surface of said platform structure (21), each of said clamping legs having a hinge end linked to two opposite portions of the perimeter of said platform structure and a free end opposite the hinge end and comprising at least one protrusion extending towards the free end of the other clamping leg, (b) A lever system for reversibly driving the two free ends of the clamping legs away from one another.

A keg connector according to the present invention is prefeably made of at least 60 wt. % of a polymer, preferably at least 80 wt. %, more preferably at least 95 wt. % of polymer.

In a preferred embodiment, each of the at least two containers are coupled to a keg connector, each connector being coupled to the same source of pressurized gas by means of a gas line provided with at least one valve. At least two keg connectors are preferably coupled to a single dispensing line (4) which is provided with at least one valve (4*v*), runs in the inner channel of the tapping column and engages in a single tapping valve. Alternatively, the tapping column may comprise more than one tapping valve, and at least two keg connectors can be coupled to a separate dispensing line, each running in the inner channel of the tapping column and engaging in a separate tapping valve.

The storing compartment can preferably contain at least three containers in their dispensing position, preferably at least four containers, and preferably comprises cooling means for cooling the containers stored in said compartment.

For easier handling, the containers can be light weight, if they are made of polymer, preferably PET. This option is also cheaper to produce and recycle, then metal kegs, which need be collected from all the different bars and restaurants for cleaning before refill, requiring an extensive transportation network. the containers are preferably pressure dispensing bag-in-containers.

The present invention is particularly adapted to containers having a height ratio, Ht/H1, of not more than 85%, preferably not more than 80%, more preferably not more than 75% or even not more than 70%, wherein Ht is the height of the container from the point of the bottom end most remote from the closure to the beginning of the shoulder region.

The height ratio, Ht/H1, is preferably at least 60%, preferably at least 65%, more preferably at least 70%, because with lower height ratios, a container would be so unstable that it would require specific means for securing it.

BRIEF DESCRIPTION OF THE FIGURES

For a fuller understanding of the nature of the present invention, reference is made to the following detailed description taken in conjunction with the accompanying drawings in which.

DETAILED DESCRIPTION OF THE INVENTION

Figure 1:
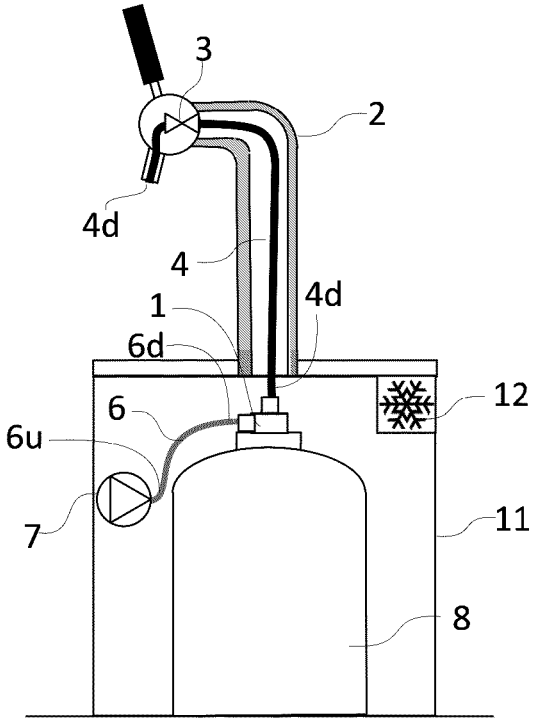
FIG.1 (PRIOR ART)
FIG. 1: shows an "under the counter" dispensing unit of the prior art.
Figure 2:
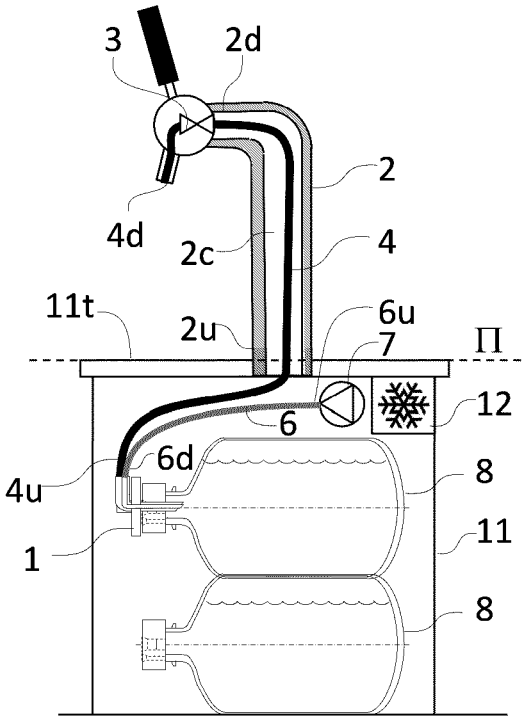
FIG. 2: shows an "under the counter" dispensing unit according to one embodiment of the present invention.

As shown in FIG. 1, conventional so called under the counter dispensing units comprise a storing compartment (11) or closet, comprising a source of pressurized gas, such as an air compressor, or a bottle of pressurized gas, such as $CO_2$ or $N_2$, and often cooling means (12) for cooling the interior of the storing compartment. A container (8) or keg, is stored in said storing compartment in a vertical stand up position. This means that the longitudinal axis, X1, running from the centre of the bottom end to the centre of the mouth, which often defines the axis of revolution of the container, stands in a vertical position, with the mouth at the highest position. A gas line (6) fluidly connects the source of pressurized gas to the interior of the container, and a dispensing line (4) runs from the opening of the container to a tapping valve (3) located at a downstream portion (2*d*) of an elongated tapping column (2) jutting out of a top plate (11*t* closing the top of the storing compartment (11). The top plate (11*a*) defines a top plane, π. An outlet opening is provided in the top plate to allow the passage of the dispensing line (4) from the interior of the storing compartment (11) into an inner channel (2*c*) of the elongated tapping column (2), from an upstream portion (2*u*) to said downstream portion (2*d*) of the tapping column. The dispensing line (4) engages into the tapping valve in ways known to the persons skilled in the art, including e.g., a pinch valve. The present invention is not limited by any type of tapping valve available in the art for beverage dispensing units.

Figure 7:
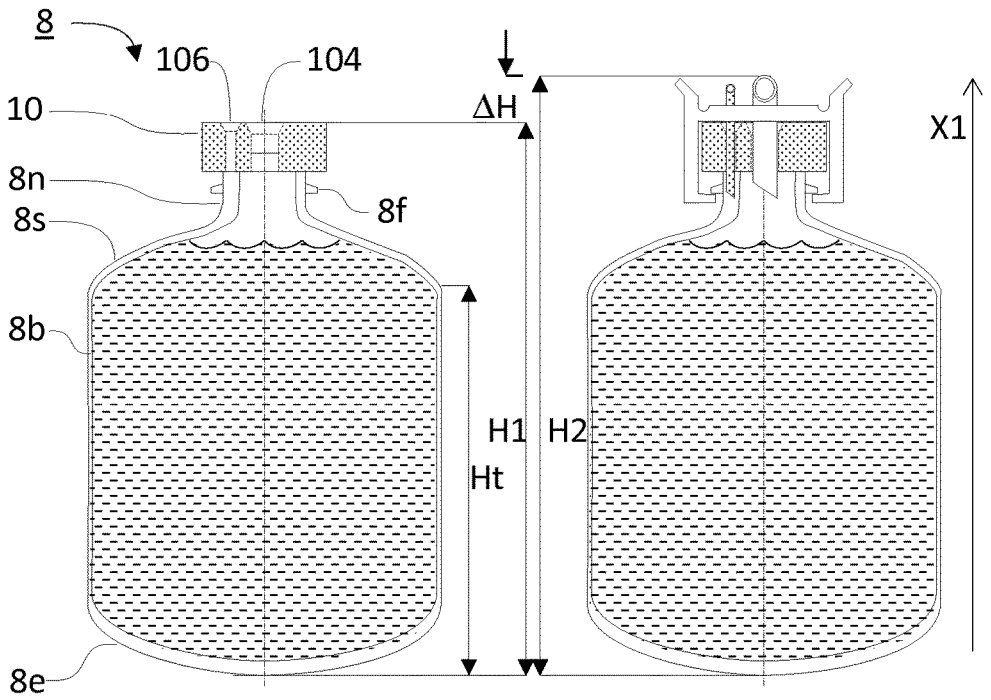
FIG. 7: shows a container with and without a keg connector with corresponding heights, H1, H2.
Figure 7:
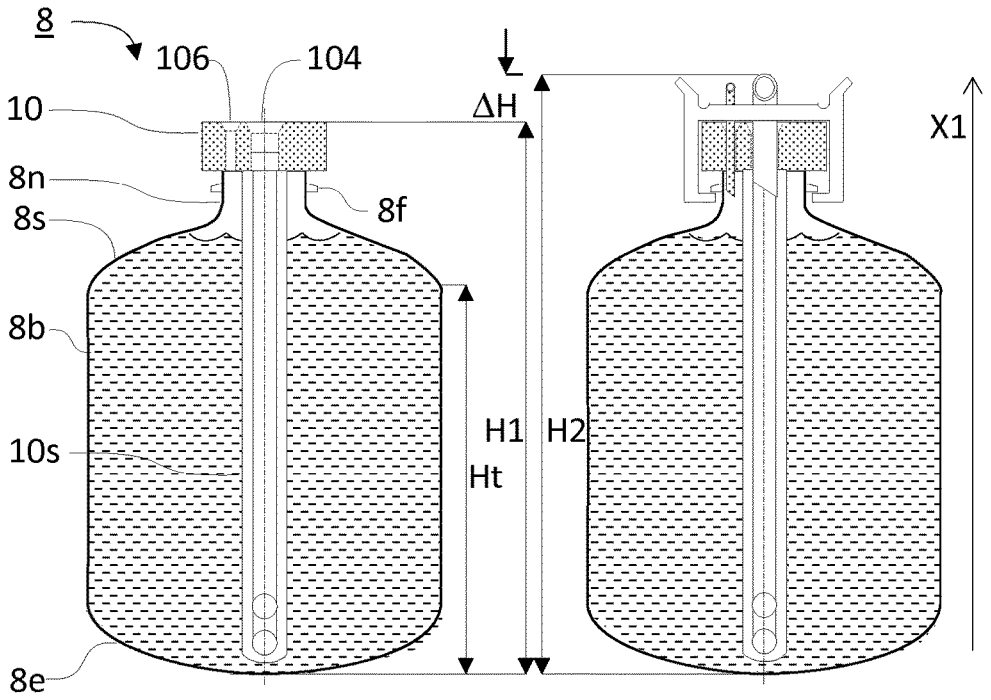

Typically, 50 liter kegs (8) generally made of metal are used in such conventional dispensing units. Such kegs cannot be lifted or otherwise handled easily; and they are usually rolled over the rim of their bottom base to bring them in front of the storing compartment (11) and positioned vertically. A keg connector is used to couple both gas line (6) and dispensing line (4). With the wide-spreading use of containers of smaller capacity, it is clear that the volume of the storing compartment (11) is not efficiently taken advantage of if such smaller kegs are arranged vertically like the larger 50 liter kegs. The containers used in a dispensing device according to the present invention typically have a capacity of 8 to 25 l and are generally made of polymers such as PET as discussed in the introduction. As illustrated in FIG. 7, such containers (8) extend over a height, H1, along a longitudinal axis, X1, from:

(i) a closure (10) sealing an opening of the container, adjacent to (ii) a neck region (8*n*) broadening into (iii) a shoulder region (8*s*) until reaching (iv) a substantially cylindrical body portion (8*b*) adjacent to (v) a bottom end (8*e*), The shoulder region (8*s*) can be in the shape of a circularly symmetric ellipsoidal cap (i.e., having an axis of revolution or, in other words, having a circular open edge), preferably a spherical cap. With blow-moulded, polymeric containers, the bottom end (8*e*) can also have a similarly circularly symmetric ellipsoidal cap, the shoulder ellipsoidal cap and the bottom end ellipsoidal cap sandwiching the cylindrical body portion (8*b*).

According to the present invention, the storing compartment is designed for storing more than one such keg in a more or less horizontal dispensing position, corresponding to a position wherein the longitudinal axis, X1, of each container forms a storing angle of ±30° (i.e., comprised between −30° and +30° with respect to the top plane, π, preferably comprised between ±10°, more preferably ±5°, most preferably substantially parallel to the plane, π.

Figure 3:
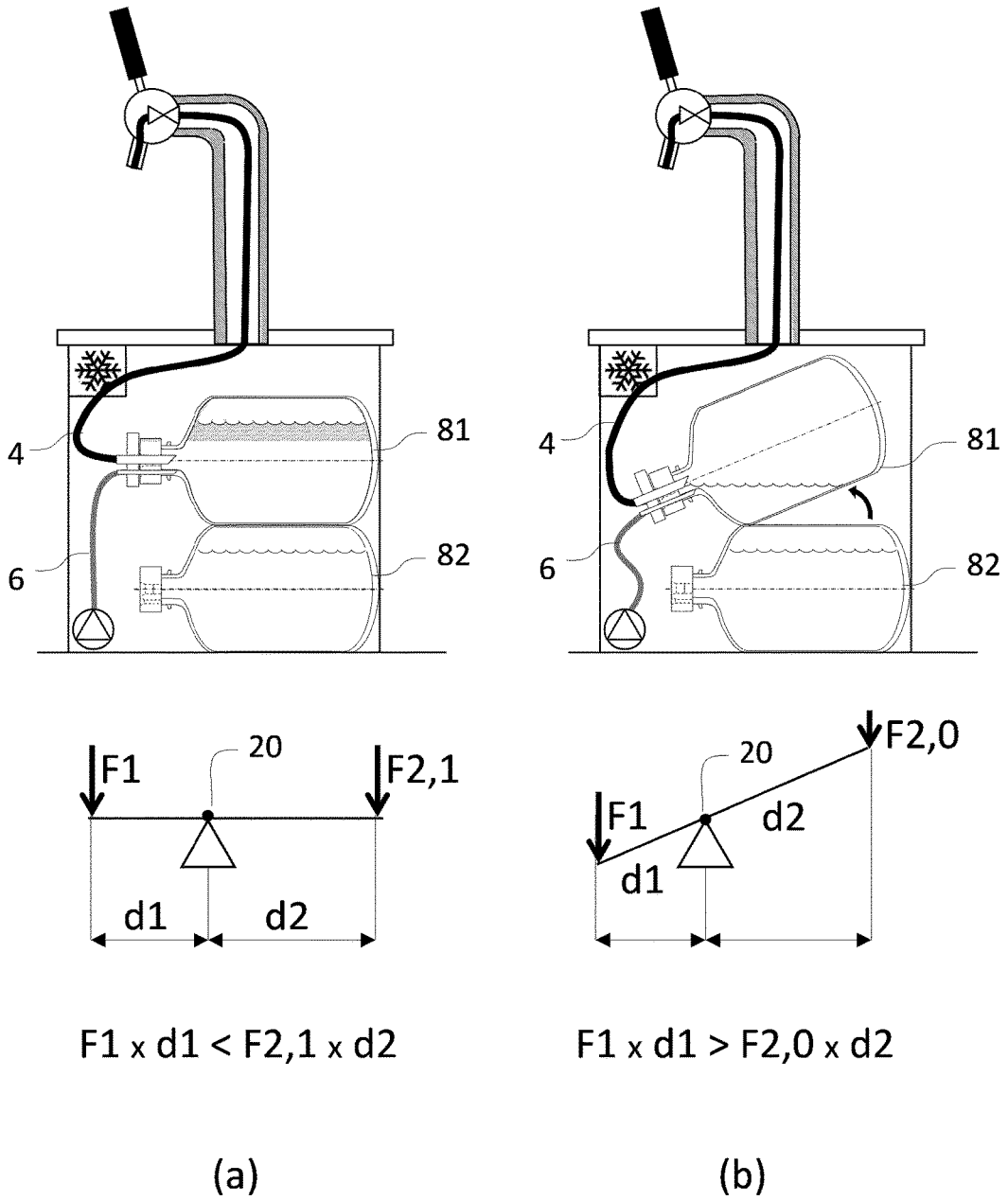
FIG. 3: shows the danger of a tilting container when stored horizontally.
Figure 4:
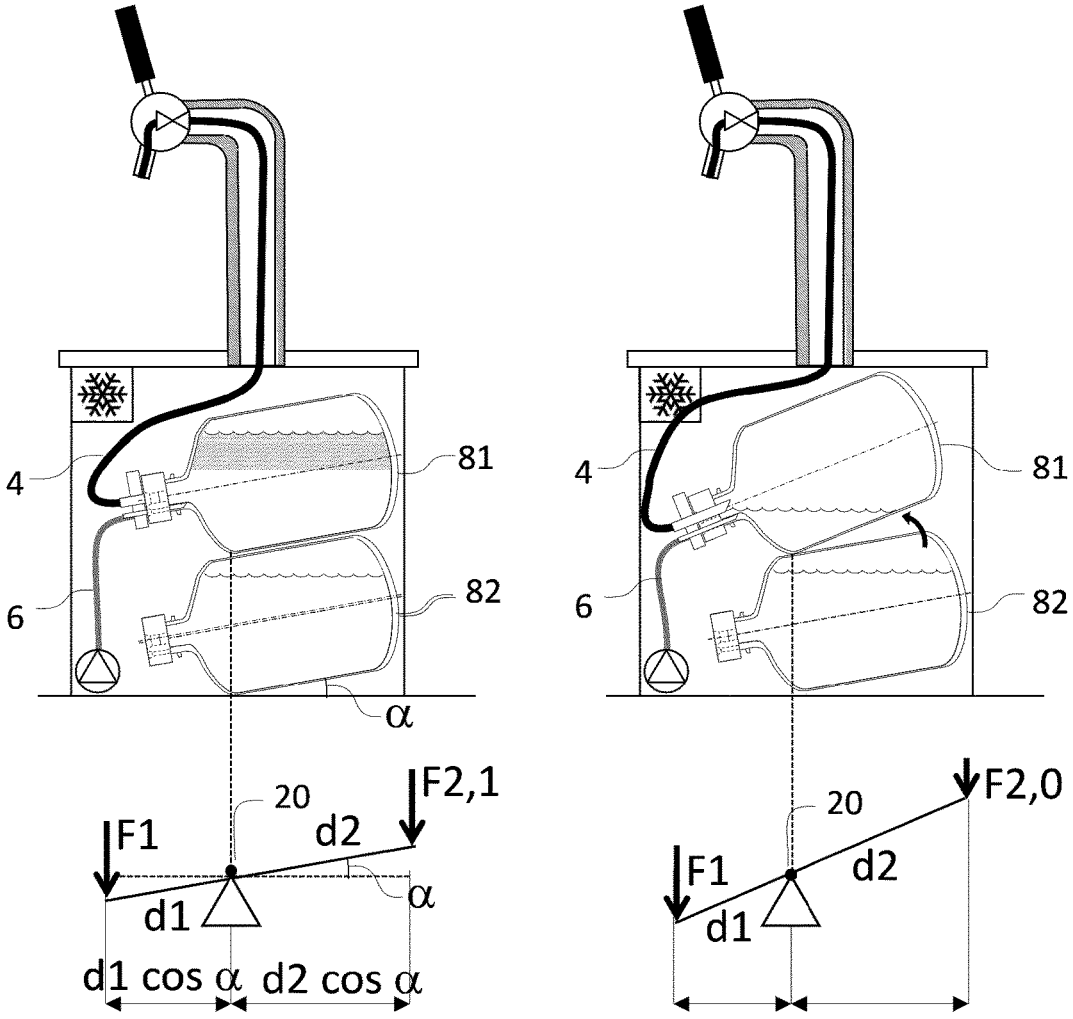

As illustrated in FIG. 3, laying a conventional container (81) horizontally with a conventional keg connector may be stable when the container is full of beverage. Indeed, the tilting moment about a tilting axis (20) corresponding to the support to the container most remote from the bottom end (8*e*) depends on the balance between F1×d1 and F2×d2, wherein, F1 is the force applied on the closure side of the container (left of the tilting axis (20) in FIG. 3), by i.a. the weights of the keg connector (1), and of the dispensing and gas lines (4, 6), F2 is the force applied on the body portion (8*b*) and end portion (8*e*) of the container (right hand side of the tilting axis (20) in FIG. 3) by the weight of the container and content thereof, d1 is the distance of the application of force, F1, to the tilting axis (20) and d2 is the distance of the application of force, F2, to the tilting axis (20).

FIGS. 3(*a*) & (*b*) illustrates an embodiment wherein the containers are stored horizontally, i.e., with their longitudinal axis, X, parallel to the top plane, π. FIGS. 3(*c*) & (*d*) illustrates an alternative embodiment wherein the containers are stored with their longitudinal axis, X1, tilted by an angle, α, with respect to the top plane, π. Because of the mouth of the container tilting downwards, the liquid moves towards the mouth as the container is being emptied, thus reducing the value of F2, 0 and increasing accordingly the value of F1 and so increasing the risk of the top container to tilting over.

Because of the substantial weight of the liquid beverage, the force F2=F2, 1 when the container is full is substantially larger than the force F2=F2, 0 when the container is nearly empty. Consequently, a container (81) can be stable when full, because F1±d1<F2, 1×d2, but will tilt and fall down when nearly empty because F1±d1>F2, 0×d2. Such tilting is more pronounced with polymeric containers (81) which are very lightweight compared with the usually metal keg connectors traditionally used in pubs and restaurants. To stabilize the containers when stored substantially horizontally, the left hand side member, F1×d1, of the tilting moment balance must be reduced, by reducing the value of F1 and/or d1. To this effect, it is essential for the present invention that the keg connector (1) does not extend too far beyond the level of the closure. As illustrated in FIG. 7, if the container has a height, H1, along the longitudinal axis, X1, from the bottom end (8*e*) to the furthest end of the closure (10), and a height, H2, from the bottom end (8*e*) to the furthest end of the keg connector (1), then the ratio (H2−H1)/H1≤5%, preferably not more than 3%, more preferably not more than 2%. This way it is possible to reduce the distance, d1, and thus the tilting moment on the left hand side of the tilting axis, 20, as seen in FIG. 3.

As discussed above, the container comprises:

(i) a closure (10) sealing an opening of the container, adjacent to (ii) a neck region (8*n*) broadening into (iii) a shoulder region (8*s*) until reaching (iv) a substantially cylindrical body portion (8*b*) adjacent to (v) a bottom end (8*e*).

With such geometry, the tilting axis of a container is generally located at the level where the cylindrical body meets the shoulder region, as shown in FIG. 3. Containers useful for the present invention generally have a height ratio, Ht/H1, of not more than 85%, preferably not more than 80%, more preferably not more than 75% or even not more than 70%, wherein Ht is the height of the container from the point of the bottom end most remote from the closure to the beginning of the shoulder region and, wherein H1 is the total height of the container from said point of the bottom end to the closure. The containers generally have a Ht/H1 ratio greater than 60%, preferably greater than 65%, more preferably at least 70%. Containers with a value of the Ht/H1 ratio higher than 85% are less prompt to tilting, because d2>>d1, so that stabilisation of the container in a horizontal or slightly tilted position is not too difficult. Containers with a value of the Ht/H1 ratio lower than 60% are so unstable that they cannot be simply laid horizontally without securing them with specific means, as with a value of d1 of the same order as the value of d2, such containers would capsize too promptly.

In order to further reduce the value of the distance, d1, it is preferred that the height, H2, includes at least 20 cm of the upstream portion (4*u*) of the dispensing line (4) and of the downstream portion (6*d*) of the gas line (6). This can be achieved by orienting the upstream portion (4*u*) of the dispensing line and the downstream portion (6*d*) of the gas line (6) are each independently coupled to the keg connector with an angle comprised between 45 and 135° preferably, between 80 and 100°, with respect to the longitudinal axis, X1, when the keg connector is coupled to the container. For example, the keg connectors illustrated in FIG. 8 have the downstream end (14*d*) of a dispensing tube (14) and the upstream end (16*u*) of a gas tube (16) oriented normal to the longitudinal axis, X1, when the keg connectors are coupled to a container, such that when a dispensing line (4) and a gas line (6) are coupled to the dispensing tube (14) and gas tube (16), respectively, they extend substantially normal away from the container's longitudinal axis, thus further reducing the value of d1.

In order to further decrease the value of the left hand side member, F1×d1, of the tilting moment balance, the weight of the keg connector (1) can be reduced by replacing metal, which is traditionally used in conventional keg connectors, by polymers for part or the whole of the keg connector. In a preferred embodiment, the keg connector is made of at least 60 wt. % of polymer, preferably at least 80 wt. %, more preferably at least 95 wt. % of polymer. Polymers such as polyethylene, polypropylene, polyamide, polyethylene terephthalate, polyurethane, and the like can be used pure, blended, and/or reinforced with fibres.

Figure 8:
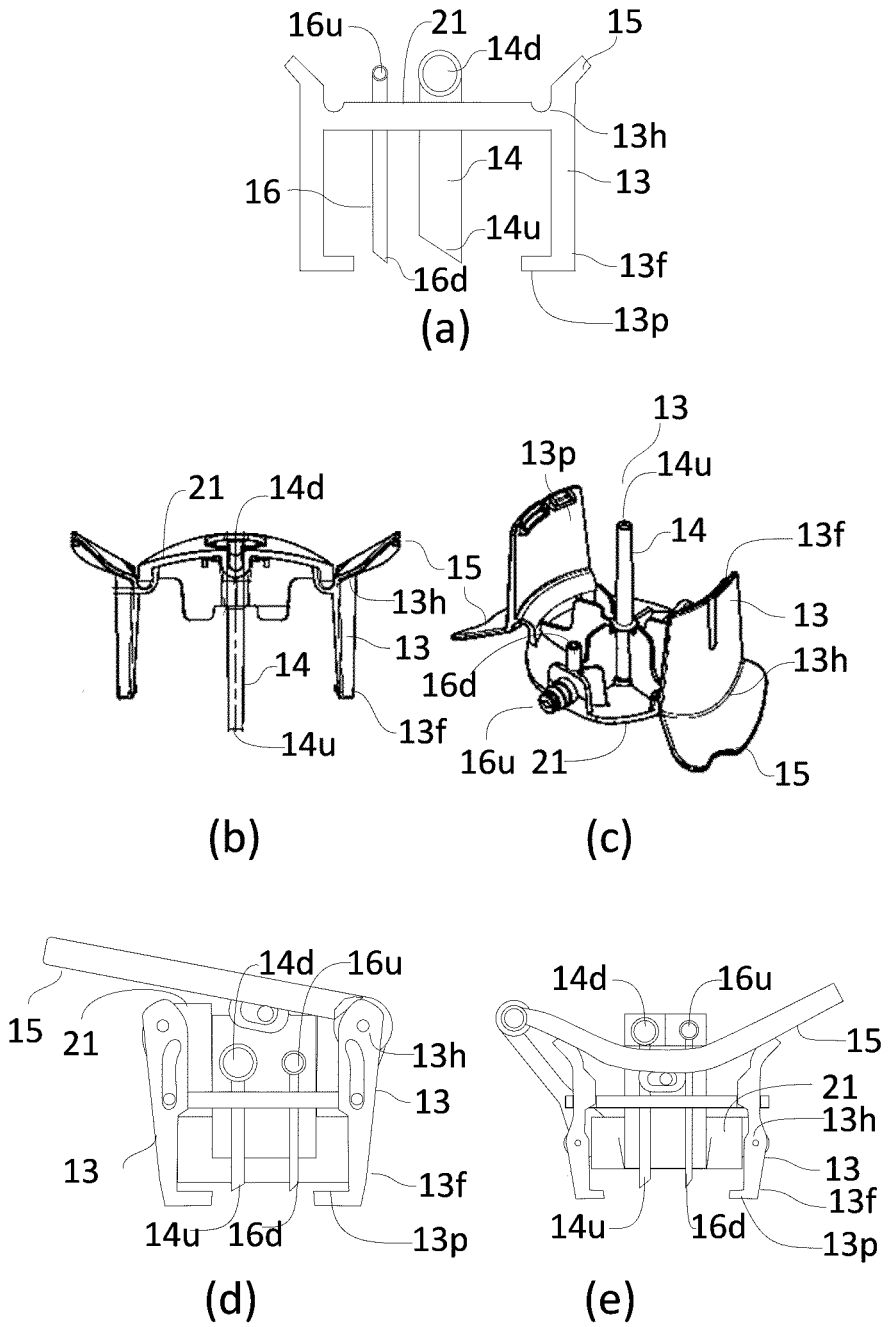
FIG. 8: shows several types of keg connectors suitable for the present invention.

Referring to FIG. 8, several keg connectors (1) suitable for the present invention are illustrated. A keg connector suitable for the present invention, is preferably re-usable several times with new containers, and can be reversibly coupled to the closure of containers. The present invention preferably does not relate to containers sold with a dispensing line permanently coupled thereto. FIG. 8(*a*) to (*c*) illustrates one kind of keg connector (FIG. 7(*c*) being a perspective view of FIG. 8(*b*)) and FIGS. 8(*d*) & (*e*) illustrates two alternative embodiments. The keg connectors illustrated in FIG. 8 have all in common a platform structure (21) defined by a perimeter and comprising an upper surface and a lower surface and being provided with a clamping system for reversibly coupling the keg connector to the closure of a keg. Said clamping system comprises:

(a) Two clamping legs (13) jutting out of the lower surface of said platform structure (21), each of said clamping legs having a hinge end (13*h*) linked to two opposite portions of the perimeter of said platform structure (21) and a free end (13*f*) opposite the hinge end and comprising at least one protrusion (13*p*) extending towards the free end of the other clamping leg, (b) A lever system (15) for reversibly driving the two free ends (13*f*) of the clamping legs (13) away from one another, (c) A dispensing tube (14) comprising an upstream end (14*u*) suitable for being engaged into a corresponding dispensing opening (104) provided in the closure (10) of the container (cf. FIG. 7), and a downstream end (14*d*) suitable for being coupled to the upstream end (4*u*) of a dispensing line (4), and (d) A gas tube (14) comprising a downstream end (16*d*) suitable for being engaged into a corresponding gas opening (106) provided in the closure (10) of the container (cf. FIG. 7), and an upstream end (16*u*) suitable for being coupled to the downstream end (6*d*) of a gas line (6).

Examples of keg connectors suitable for the present invention are disclosed e.g., in WO2014057099 (cf. present FIGS. 8(*d*) & (*e*)) or EP14161266 (cf. FIG. 8(*a*)-(*c*)), the contents of which are included herein in their entirety by reference. The keg connectors of FIGS. 8(*d*) & (*e*) are described in WO2014057099 and comprise several parts moving with respect to the platform structure (21). A dispensing tube (14) and gas tube (16) can be moved up and down with respect to the platform structure (21) by actuating lever (15). As the dispensing and gas tubes are moved up and down, the clamping legs (13) are pivoted about their hinges (13*h*) such that the free ends (13*f*) and associated protrusions (13*p*) are driven closer to one another into a clamping position upon moving the dispensing and gas tubes down with respect to the platform structure (21), and driven away from one another into an unclamped position upon moving the dispensing and gas tubes up with respect to the platform structure (21). The terms "up" and "down" are used herein with reference to the orientation of the keg connectors illustrated in FIG. 8(*a*), (*b*), (*d*), (*e*).

The keg connectors of FIG. 8(*a*) to (*c*) are described in patent application EP14161266 and comprise no movable parts. They can be integrally injection moulded in one piece. Alternatively, part of the dispensing tube (14) typically the downstream portion (14*d*) thereof can be assembled separately to facilitate cleaning of two straight tube sections of the dispensing tube (14) forming an "L" between the upstream portion (14*u*) and downstream portion (14*d*) of the dispensing tube. The hinges (13*f*) of the clamping legs (13) are formed by locally decreasing the flexural stiffness of the clamping legs. At rest, the clamping legs (13) are in their clamping position. The levers (15) are a continuation of the clamping legs (13) beyond the hinge end (13*f*), such that by pinching the two opposed levers (15) towards one another the free ends (13*f*) of the clamping legs (13) are driven away from one another to their unclamped position. Releasing the levers (15) resiliently brings back the clamping legs to their clamping position. This embodiment is much cheaper to produce and substantially lighter than the embodiment of FIGS. 8(*d*) & (*e*) discussed supra, which is advantageous to the present invention as it decreases the value of F1, as illustrated in FIG. 3 discussed supra. It may, however, be less durable because of the weakness of the resilient hinges (13*h*) of the clamping legs (13). In their clamping position, the protrusions (13*p*) of the clamping legs (13) may clamp beyond a lower rim of a skirt of the closure (10) or, preferably, beyond an annular flange (13*f*) protruding out of, and along a whole perimeter of the neck region substantially normal to the longitudinal axis, X1 (cf. FIG. 7).

Closures (10) suitable for the present invention are described e.g., in WO2009/090225, WO2009/090224, WO2009/090223, WO2012004223, the contents of which are included herein in their entirety by reference. The closure (10) generally comprises a skirt provided with coupling means for reversibly coupling to the neck region (8*n*) of the container by means of a thread, bayonet or snap features. The skirt defines a lower rim below which the protrusions (13*p*) can engage to clamp the keg connector to the closure. As discussed supra, it is, however, preferred to clamp the clamping legs below an annular flange (8*f*) integrally part of the container (cf. FIG. 7). The closure comprises a dispensing opening (104) and a gas opening (106) for snuggly accommodating the corresponding dispensing tube (14) and gas tube (16) of the keg connector (1) upon coupling it to the container. Since the dispensing opening (104) in the closure is sealed prior to use, the upstream end (14*u*) of the dispensing tube (14) of a keg connector must be sufficiently hard and sharp to disrupt the seal and create a fluid communication with the interior of the container upon engaging into the corresponding dispensing opening (104) of the closure (10). In most cases the same applies with the downstream end (16*d*) of the gas tube (16) apart from the case wherein the container is a so called pressure dispensing bag-in-container illustrated in FIG. 7(*a*), wherein the container comprises an outer container and a flexible, collapsible inner bag, containing the beverage to be dispensed. A vent is provided to bring the space between the outer container and the inner bag in fluid communication with the surrounding atmosphere. Said vent is in fluid communication with the gas opening (106) of the closure (10). In this case, the gas opening (106) of the closure (10) of a pressure dispensing bag-in-container needs not be sealed prior to coupling a keg connector (1) to the container. Alternatively, the container is a traditional keg as illustrated in FIG. 7(*b*), wherein the pressurized gas is injected into the headspace above the level of the beverage, and wherein a hollow spear (10*s*) is fixed to the closure at a proximal end thereof and is provided at a distal end thereof with at least one opening, used to bring in fluid communication the dispensing tube (14) of the keg connector with the liquid located most remote from the container's opening in the direction of gravity. Since the containers are stored in their dispensing position in a lying position, it is essential that the spear (10*s*) be flexible enough such that the distal end thereof is always close to the lowest point of the container with respect to the container's opening in the direction of gravity.

Figure 4:
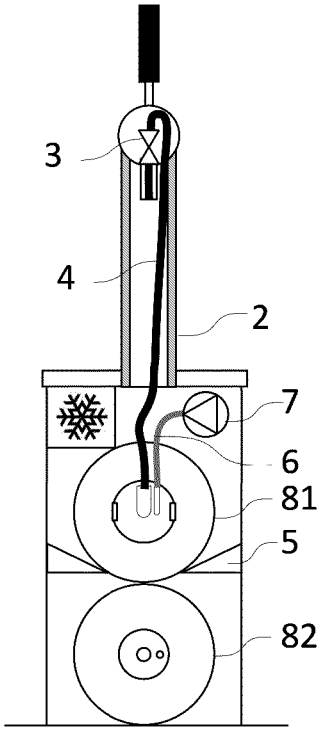
FIG. 4: shows an "under the counter" dispensing unit according to two embodiments of the present invention.
Figure 4:
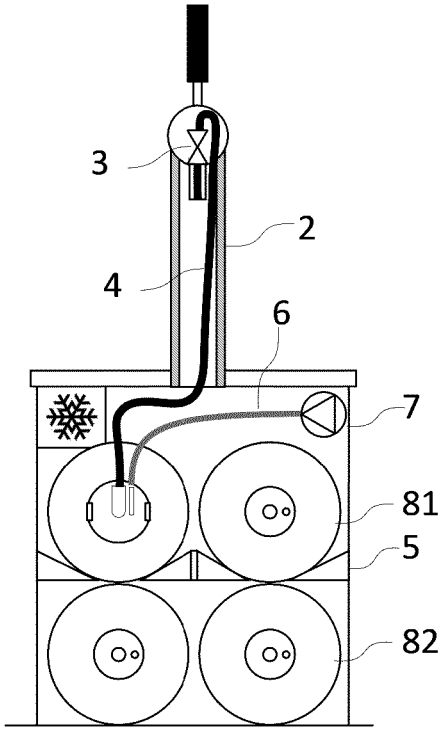

The storing compartment (11) can be so designed as to contain two containers in their dispensing position as shown in FIG. 4(*a*). It may be designed to contain three, four or even more containers in their dispensing position (cf. FIG. 4(*b*) showing four containers stored in their dispensing position). The means (5) for receiving the containers can be any means known in the art. For example, as illustrated in FIG. 4, the receiving means (5) can be in the form of pegs or flanges extending from the lateral walls of the compartment suitable for supporting a first container (81) located above a second container (82). Alternatively, shelves can be used instead. In an embodiment the lateral walls of the storing compartment can serve to keep a first keg (81) resting on top of a second keg (82), though this solution does not give easy access for removal of the lower keg (82) without removing the top keg (81) first. Since the size of the containers (8) may vary from one type of beer to the other, it is advantageous if the position of the receiving means (5) can be changed easily.

Figure 5:
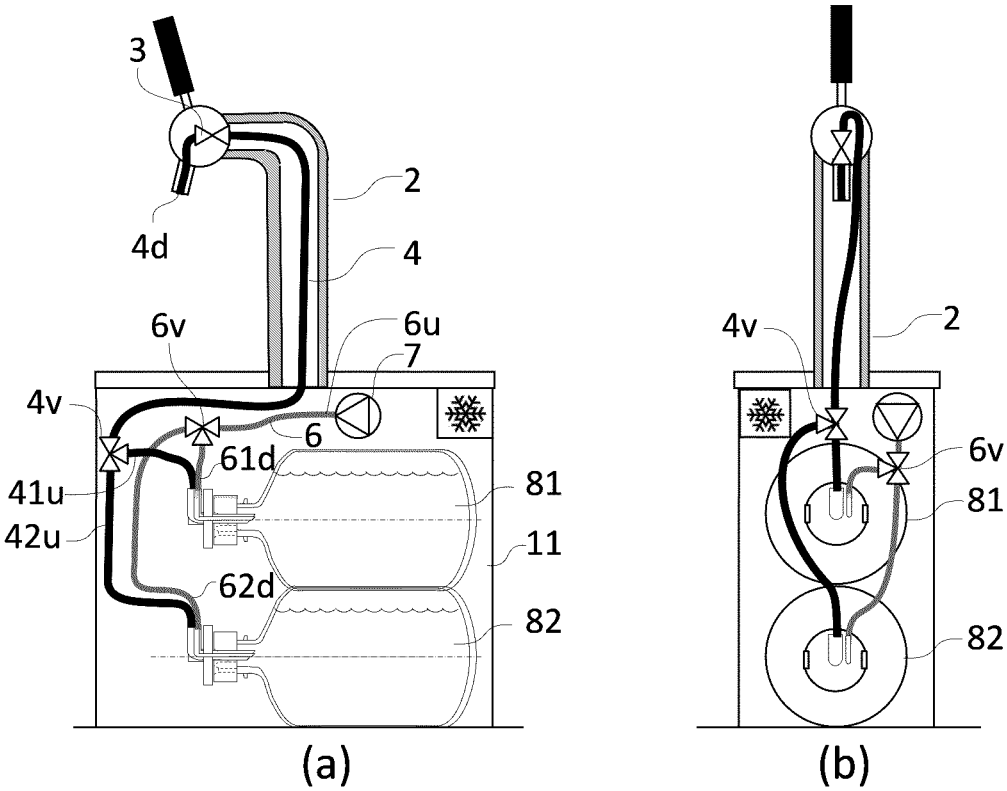
FIG. 5: shows an "under the counter" dispensing unit according to an embodiment of the present invention with several containers connected to a same dispensing tap.
Figure 6:
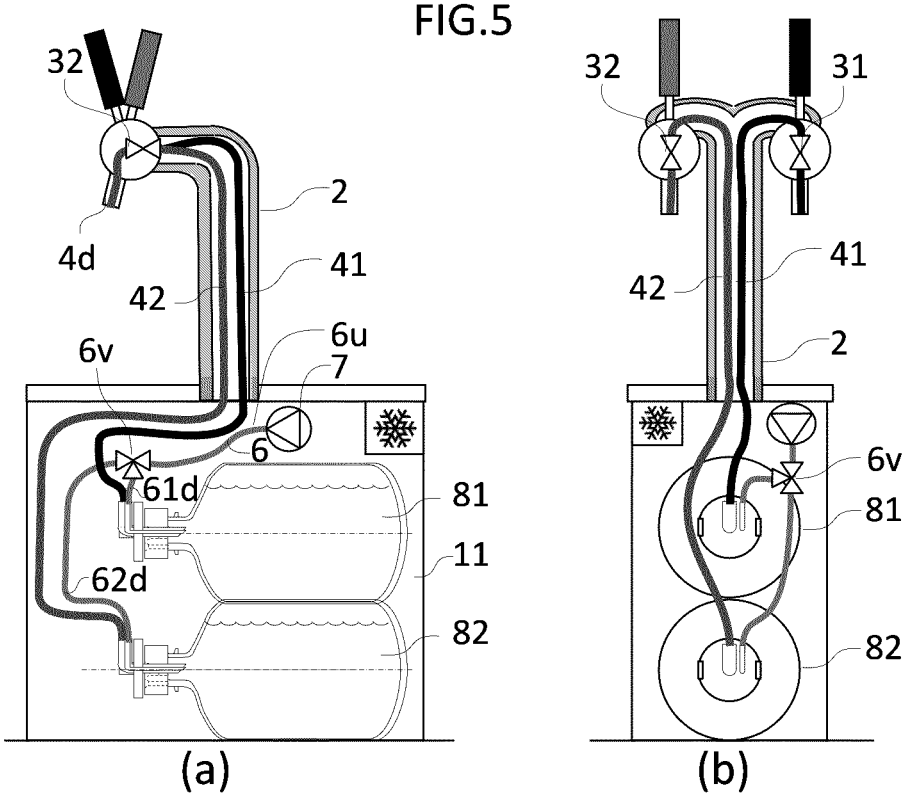
FIG. 6: shows an "under the counter" dispensing unit according to an embodiment of the present invention with several containers connected to separate dispensing taps.

As shown in FIGS. 5 & 6, at least two of the containers stored in the storing compartment (11) can be provided with a keg connector (1) and coupled to a gas line (6) and to a dispensing line (4). If a single source (7) of pressurized gas is used, the gas line (6) is preferably provided with a three way valve (6*v*) controlling the flow of pressurized gas towards a first (81) or second (82) container, each coupled to a corresponding downstream portion (61*d*, 62*d*) of the gas line (6) downstream from the three way valve (6*v*).

In the embodiment illustrated in FIG. 5, the two containers (81, 82) are coupled to a single tapping valve (3). This embodiment permits to multiply the dispensing autonomy of the dispensing device by the number of containers (81, 82) coupled to a given tapping valve (3). Of course, all containers preferably contain the same beverage in order not to pollute the dispensing line with different flavours. The dispensing line (4) can be provided with a three or more way valve (4*v*) to control the flow of liquid from one or the other of the containers (81, 82) coupled to respective upstream portions of dispensing lines (41*u*, 42*u*), through the valve (4*v*) and to the common tapping valve (3).

In the embodiment illustrated in FIG. 6 the two containers are independently coupled to two different tapping valves (31, 32) at the downstream portion (2*d*) of the same tapping column (2) by means of two different dispensing lines (41, 42). This embodiment is particularly suitable for offering a wider selection of specialty beers each stored in a different container (81, 82) and dispensed from different tapping valves (31, 32) out of the same column (2).

The dispensing device of the present invention is adapted to the new evolution of smaller, lightweight containers used to dispense fermented beverages such as beer and other carbonated beverages. Handling of the containers is greatly facilitated and capacity of storage of the containers is optimized with the present invention.

| REF | DESCRIPTION |
|---|---|
| 1 | keg connector |
| 2 | tapping column |
| 2c | inner channel of tapping column |
| 2d | downstream portion of the tapping column |
| 2u | upstream portion of the tapping column |
| 3 | tapping valve |
| 4 | dispensing line |
| 4d | downstream end of the dispensing line |
| 4u | upstream end of the dispensing line |
| 4v | valve of dispensing line |
| 5 | Means for receiving a container 8 |
| 6 | gas line |
| 6d | downstream end of the gas line |
| 6u | upstream end of the gas line |
| 6v | valve of gas line |
| 7 | source of pressurized gas |
| 8 | container |
| 8b | body portion of container |
| 8e | bottom end of container |
| 8f | annular flange at neck of container |
| 8n | neck region of container |
| 8s | shoulder region of container |
| 10 | closure |
| 11 | storing compartment |
| 11t | top plate of storing compartment |
| 12 | cooling means |
| 13 | clamping leg of keg connector |
| 13f | clamping leg free end |
| 13h | clamping leg hinge end |
| 13p | clamping leg protrusion |
| 14 | dispense tube of keg connector |
| 14d | downstream portion of dispense tube |
| 14u | upstream portion of dispense tube |
| 15 | lever controlling clamping legs of keg connector |
| 16 | gas tube of keg connector |
| 16d | downstream portion of gas tube |
| 16u | upstream portion of gas tube |
| 20 | tilting axis |
| 21 | platform structure of keg connector 1 |
| 31 | first tapping valve |
| 32 | second tapping valve |
| 41 | dispensing line leading to first container 81 |
| 42 | dispensing line leading to second container 82 |
| 41u | upstream portion of dispensing line to first container 81 |
| 42u | upstream portion of dispensing line to second container 82 |
| 61d | downstream end of gas line leading to first container 81 |
| 62d | downstream end of gas line leading to second container 82 |
| 81 | first container |
| 82 | second container |
| 104 | dispensing opening in closure 10 |
| 106 | gas opening in closure 10 |
| H1 | container height, including closure 10 |
| H2 | container height, including keg connector 1 |
| ΔH | H2 − H1 |
| X1 | container longitudinal axis |
| π | top plane defined by the storing compartment top plate 11t |

The invention claimed is:

1. A beverage dispensing device comprising:

(a) a container containing a liquid beverage to be dispensed, and extending over a height, Hl, along a longitudinal axis, X1, from:

(i) a closure sealing an opening of the container, adjacent to (ii) a neck region broadening into (iii) a shoulder region until reaching (iv) a substantially cylindrical body portion adjacent to (v) a bottom end;

(b) a beverage dispensing line comprising an inlet end located at an upstream portion of the dispensing line, and an outlet end located at a downstream portion of the dispensing line, (c) a gas line comprising an inlet end and an outlet end said inlet end being connected to a source of pressurized gas;

(d) a keg connector suitable for bringing in fluid communication the interior of the container with the inlet end of the dispensing line and with the outlet end of the gas line by coupling said keg connector to the closure of the container;

(e) storing compartment comprising means for receiving at least two containers, and closed at a top by a top plate defining a top plane, Π, said top plate being provided with an outlet opening suitable for allowing the outlet end of the dispensing line to be out of the storing compartment, while the inlet end thereof is connected to said keg connector coupled to the closure of one container stored in said storing compartment; and (f) an elongated tapping column, comprising an upstream portion fixed to said top plate and a downstream portion provided with a tapping valve element with an inner channel linking the upstream portion to the downstream portion of the column and in fluid communication with the outlet opening, said inner channel being suitable for receiving the dispensing line, and engaging the downstream portion of the dispensing line into the tapping valve element for controlling flow of liquid out of the outlet end, wherein, the means for receiving at least two containers in the storing compartment are such that each container is stored in a dispensing position with a longitudinal axis, X1, forming a storing angle comprised of between −30° and +30° with respect to the top plane, Π, and in that, the keg connector is such that height, H2, measured along the longitudinal axis, X1, between a bottom end of a first container and the furthest point of the keg connector coupled to the closure of said connector is not more than 5% greater than height, H1, of the first container without keg connector, $(H2-H1)/H1 \leq 5\%$, wherein the upstream portion of dispensing tube and the downstream portion of a gas tube are each independently coupled to the keg connector with an angle comprised between 45 and 135° or between 80 and 100°, with respect to the longitudinal axis, X1, when the keg connector is coupled to the first container, such that the height, H2, or includes at least 20 cm of both the upstream portion of the dispensing tube and the downstream portion of the gas tube, wherein the keg connector is re-usable several times with new containers, and can be reversibly coupled to the new containers, wherein the keg connector comprises a platform structure defined by a perimeter and comprising an upper surface and a lower surface and being provided with a clamping system for reversibly coupling the keg connector to the closure of a keg, said clamping system comprising:

(i) two clamping legs jutting out of the lower surface of said platform structure, each of said clamping legs having a hinge end linked to two opposite portions of the perimeter of said platform structure and a free end opposite the hinge end and comprising at least one protrusion extending towards the free end of the other clamping leg, (ii) a lever system for reversibly driving the two free ends of the clamping legs away from one another.

2. The beverage dispensing device according to claim 1, wherein the storing angle is comprised between +10°, or between +5° with respect to the top plane, Π.

3. The beverage dispensing device according to claim 1, wherein the keg connector is made of at least 60 wt. % of a polymer, or at least 80 wt. %, more or at least 95 wt. % of polymer.

4. The beverage dispensing device according to claim 3, wherein each of the at least two containers are coupled to a keg connector, each connector being coupled to the source of pressurized gas by means of the gas line provided with at least one valve.

5. The beverage dispensing device according to claim 4, wherein at least two keg connectors are coupled to a single dispensing line which is provided with at least one valve, runs in the inner channel of the tapping column and engages in a single tapping valve.

6. The beverage dispensing device according to claim 5, wherein the tapping column comprises more than one tapping valve, and wherein at least two keg connectors are coupled to a separate dispensing line, each running in the inner channel of the tapping column and engaging in a separate tapping valve.

7. The beverage dispensing device according to claim 6, wherein the storing compartment can contain at least three containers in respective dispensing positions, or at least four containers.

8. The beverage dispensing device according to claim 7, wherein the storing compartment comprises cooling means for cooling the containers stored in said compartment.

9. The beverage dispensing device according to claim 8, wherein the containers are made of polymer, or PET.

10. The beverage dispensing device according to claim 9, wherein the containers are pressure dispensing bag-in-containers.

11. The beverage dispensing device according to claim 10, wherein the first container has a height ratio, Ht/H1, of not more than 85%, or not more than 80%, or not more than 75% or even not more than 70%, wherein Ht is the height of the container from a point of the bottom end most remote from the closure to a beginning of a shoulder region.

12. The beverage dispensing device according to claim 11, wherein the container has a height ratio, Ht/H1, of at least 60%, or at least 65%, or at least 70%, wherein Ht is the height of the container from the point of the bottom end most remote from the closure to the beginning of the shoulder region.

* * * * *